US012742565B2

(12) United States Patent
Hashikawa

(10) Patent No.: US 12,742,565 B2
(45) Date of Patent: Sep. 22, 2026

(54) AIR CONDITIONER

(71) Applicant: Mitsubishi Electric Corporation, Tokyo (JP)

(72) Inventor: Takahiro Hashikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 142 days.

(21) Appl. No.: 18/861,685

(22) PCT Filed: May 23, 2022

(86) PCT No.: PCT/JP2022/021090
§ 371 (c)(1),
(2) Date: Oct. 30, 2024

(87) PCT Pub. No.: WO2023/228243
PCT Pub. Date: Nov. 30, 2023

(65) Prior Publication Data
US 2025/0305706 A1 Oct. 2, 2025

(51) Int. Cl.
*F24F 11/81* (2018.01)
*F24F 110/10* (2018.01)

(52) U.S. Cl.
CPC ..... *F24F 11/81* (2018.01); *F24F 2110/10* (2018.01)

(58) Field of Classification Search
CPC ..... F24F 11/81; F24F 2110/10
See application file for complete search history.

(56) References Cited

U.S. PATENT DOCUMENTS

2015/0082820 A1* 3/2015 Takahashi ..... B60H 1/0005 62/238.7
2017/0108231 A1 4/2017 Hasegawa et al.

FOREIGN PATENT DOCUMENTS

JP S60-162143 A 8/1985
JP 2005-147484 A 6/2005
JP 2006313027 A * 11/2006
JP 2020-533554 A 11/2020
JP 2021076290 A * 5/2021
(Continued)

OTHER PUBLICATIONS

Takebayashi, Air Conditioner, May 20, 2021, JP2021076290A, Whole Document (Year: 2021).*
(Continued)

*Primary Examiner* — Larry L Furdge
(74) *Attorney, Agent, or Firm* — Posz Law Group, PLC

(57) ABSTRACT

The refrigerant circuit is configured to circulate the refrigerant through the compressor, the outdoor heat exchanger, the second indoor heat exchanger, the expansion valve, and the first indoor heat exchanger in this order during a cooling operation. The second indoor heat exchanger is configured to allow each of outdoor air flowing through an air intake passage and indoor air flowing through the air exhaust passage to pass through the second indoor heat exchanger. The indoor unit further comprises a switching device configured to switch between a state in which the second indoor heat exchanger is located in the air intake passage and a state in which the second indoor heat exchanger is located in the air exhaust passage. The first indoor heat exchanger is disposed on a windward side with respect to the second indoor heat exchanger in the air intake passage.

2 Claims, 8 Drawing Sheets

(56) References Cited

FOREIGN PATENT DOCUMENTS

| | | | |
|---|---|---|---|
| WO | 2016/002071 | A1 | 1/2016 |
| WO | 2019/078247 | A1 | 4/2019 |

OTHER PUBLICATIONS

Inoue et al., Ventilation Air Conditioner, Nov. 16, 2006, JP2006313027A, Whole Document (Year: 2006).*
International Search Report of the International Searching Authority mailed Aug. 2, 2022 for the corresponding International Application No. PCT/JP2022/021090 (and English translation).

* cited by examiner

AIR CONDITIONER

CROSS REFERENCE TO RELATED APPLICATION

This application is a U.S. national stage application of PCT/JP2022/021090 filed on May 23, 2022, the contents of which are incorporated herein by reference.

TECHNICAL FIELD

The present disclosure relates to an air conditioner.

BACKGROUND ART

For one of types of air conditioners, there is an outdoor air treatment unit configured to adjust a temperature of air suctioned from outdoor, bring the air into a room, and discharge indoor air to outside of the room. For the outdoor air treatment unit, Japanese Patent Laying-Open No. 2021-076290 (PTL 1) discloses a technique relating to a reheating/dehumidifying operation in which the outdoor air is cooled and dehumidified by a first heat exchanger and is then reheated by a second heat exchanger installed on a downstream side in an air passage with respect to the first heat exchanger. The reheating is to heat air that has been once cooled.

The reheating/dehumidifying operation is required in the case of a load condition in which a latent heat load is high and a sensible heat load is low. The latent heat is heat involving a state change, whereas the sensible heat is heat involving a temperature change. The load condition in which the latent heat load is high and the sensible beat load is low is a condition in which a request for dehumidification is high but the temperature is not desired to be decreased so much. In such a case, the technique of Japanese Patent Laying-Open No. 2021-076290 (PTL 1) can be applied.

CITATION LIST

Patent Literature

PTL 1: Japanese Patent Laying-Open No. 2021-076290

SUMMARY OF INVENTION

Technical Problem

However, the reheating is not required in a load condition in which the latent heat load is low and the sensible heat load is sufficiently high. The load condition in which the latent heat load is low and the sensible heat load is sufficiently high is a condition in which the request for dehumidification is not high but the temperature is desired to be decreased. With the technique of Japanese Patent Laying-Open No. 2021-076290 (PTL 1), the request in such a case cannot be satisfied.

An object of the present disclosure is to provide an air conditioner that can be operated highly efficiently both when reheating is required and when no reheating is required.

Solution to Problem

The present disclosure comprises a refrigerant circuit comprising an outdoor unit and an indoor unit. The outdoor unit comprises a compressor configured to compress and discharge refrigerant, and an outdoor heat exchanger. The indoor unit comprises a first expansion valve configured to decompress the refrigerant, a first indoor heat exchanger, a second indoor heat exchanger, an air intake device configured to bring outdoor air into a room through an air intake passage, and an air exhaust device configured to discharge indoor air to outside of the room through an air exhaust passage. The refrigerant circuit is configured to circulate the refrigerant through the compressor, the outdoor heat exchanger, the second indoor heat exchanger, the first expansion valve, and the first indoor heat exchanger in this order during a cooling operation. The second indoor heat exchanger is configured to allow each of the outdoor air flowing through the air intake passage and the indoor air flowing through the air exhaust passage to pass through the second indoor heat exchanger. The indoor unit further comprises a switching device configured to switch between a state in which the second indoor heat exchanger is located in the air intake passage and a state in which the second indoor heat exchanger is located in the air exhaust passage. When switching is made by the switching device to the state in which the second indoor heat exchanger is located in the air intake passage, the first indoor heat exchanger is disposed on a windward side with respect to the second indoor heat exchanger in the air intake passage.

Advantageous Effects of Invention

The air conditioner according to the present disclosure can be operated highly efficiently both when reheating is required and when no reheating is required.

DESCRIPTION OF EMBODIMENTS

Figure 1:
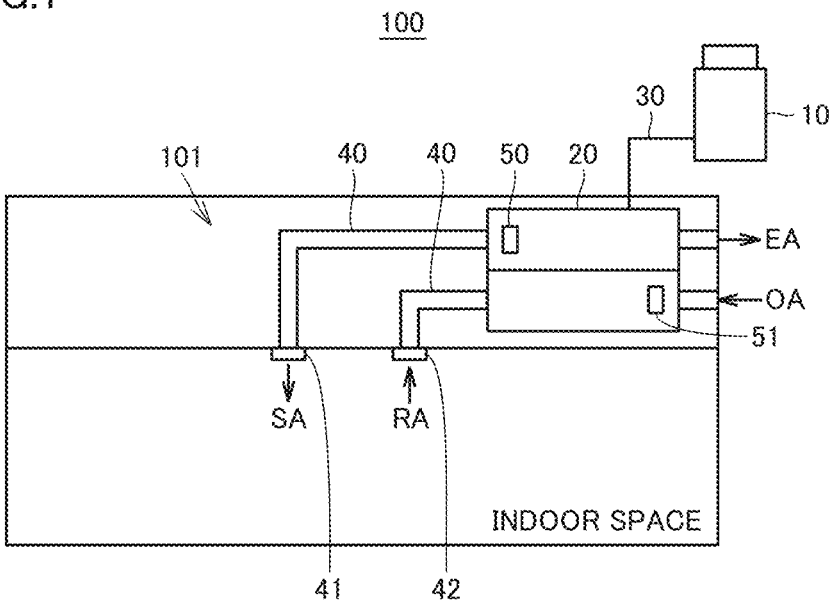
FIG. 1 is a schematic diagram showing a configuration of an air conditioner according to a first embodiment.

Hereinafter, embodiments of the present disclosure will be described in detail with reference to figures. In each of the below-described embodiments, when the number, amount, or the like is stated, the scope of the present disclosure is not necessarily limited to the number, amount, or the like unless otherwise stated particularly. The same and corresponding components are denoted by the same reference characters and the same explanation may not be described repeatedly. It is initially expected to use configurations in the embodiments in appropriate combinations.

First Embodiment

FIG. 1 is a schematic diagram showing a configuration of an air conditioner 100 according to a first embodiment. Air conditioner 100 comprises an outdoor unit 10, an indoor unit 20, and a refrigerant pipe 30. FIG. 1 shows a schematic view when indoor unit 20 is laterally viewed. Outdoor unit 10 and indoor unit 20 are connected by refrigerant pipe 30. Indoor unit 20, which is an outdoor air treatment unit, is disposed in a ceiling space 101. Indoor unit 20 brings outdoor air OA into a duct 40 and sends out the air as intake air SA from a sending port 41. Indoor unit 20 brings indoor air RA into a duct 40 via a suction port 42, and discharges indoor air RA to outside as exhaust air EA.

Indoor unit 20 comprises an intake air temperature detection unit 50 and an outdoor air temperature detection unit 51 in a main body casing. Intake air temperature detection unit 50 is a device constituted of a temperature sensor configured to measure a temperature of intake air SA sent out into the room. Outdoor air temperature detection unit 51 is a device constituted of a temperature sensor configured to measure a temperature of outdoor air OA brought into the room from outdoor.

Figure 2:
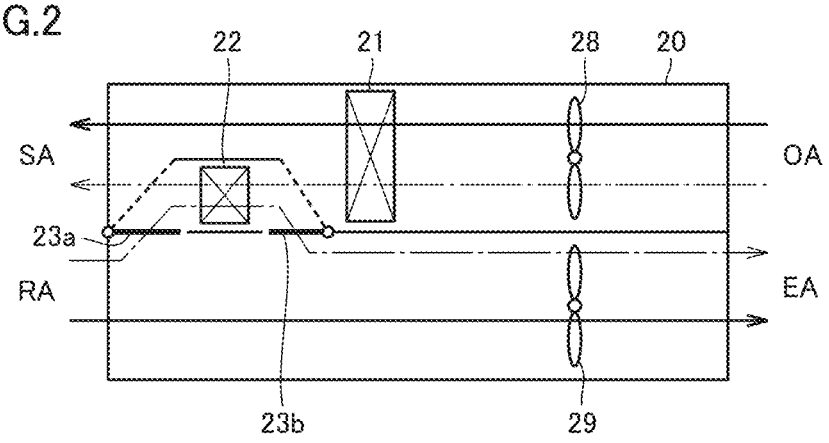
FIG. 2 is a schematic diagram showing a configuration of an indoor unit according to the first embodiment.

FIG. 2 is a schematic diagram showing a configuration of indoor unit 20 according to the first embodiment. FIG. 2 is a schematic diagram when indoor unit 20 is viewed from above. Indoor unit 20 comprises, in the main body casing, a first indoor heat exchanger 21, a second indoor heat exchanger 22, an air blower 28 for intake of air, an air blower 29 for exhaust of air, and a reheating damper constituted of a first damper 23*a* and a second damper 23*b*. Each of various arrows in FIG. 2 represents a flow of air.

Each of first indoor heat exchanger 21 and second indoor heat exchanger 22 is an indoor heat exchanger configured to exchange heat between refrigerant and air. Outdoor air OA is supplied into the room as intake air SA after passing through first indoor heat exchanger 21 by air blower 28 serving as an air intake device. An air passage in which outdoor air OA flows into the room is referred to as "air intake passage". On the other hand, indoor air RA is exhausted to the outside as exhaust air EA by air blower 29 serving as an air exhaust device. An air passage in which indoor air RA flows to the outside of the room is referred to as "air exhaust passage".

As shown in FIG. 2, the reheating damper constituted of first damper 23*a* and second damper 23*b* and serving as a switching device can switch between a state in which second indoor heat exchanger 22 is located in the air intake passage and a state in which second indoor heat exchanger 22 is located in the air exhaust passage. Thus, second indoor heat exchanger 22 is configured to allow each of the air flowing through the air intake passage and the air flowing through the air exhaust passage to pass through second indoor heat exchanger 22.

By the switching of first damper 23*a* and second damper 23*b*, outdoor air OA flows through the air intake passage in accordance with one of the following patterns: a pattern in which outdoor air OA passes through first indoor heat exchanger 21 and then flows into the room without passing through second indoor heat exchanger 22; and a pattern in which outdoor air OA passes through first indoor heat exchanger 21, then passes through second indoor heat exchanger 22, and flows into the room.

By the switching of first damper 23*a* and second damper 23*b*, indoor air RA flows through the air exhaust passage in accordance with one of the following patterns: a pattern in which indoor air RA passes through second indoor heat exchanger 22 and then flows to the outside; and a pattern in which indoor air RA flows to the outside without passing through second indoor heat exchanger 22.

Figure 3:
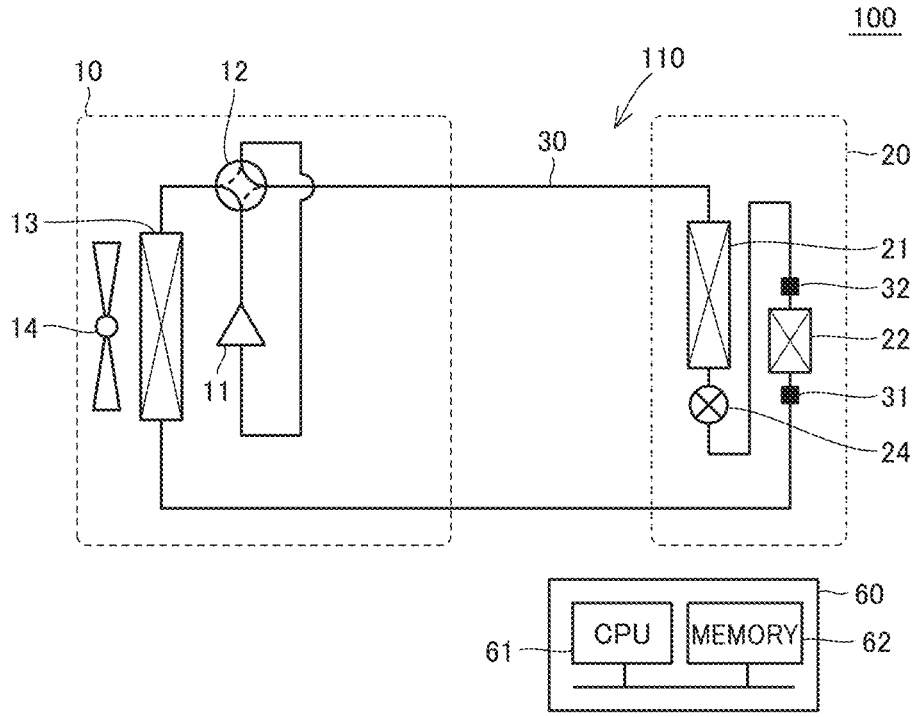
FIG. 3 is a diagram showing a refrigerant circuit of the air conditioner according to the first embodiment.

FIG. 3 is a diagram showing a refrigerant circuit 110 of air conditioner 100 according to the first embodiment. As shown in FIG. 3, air conditioner 100 comprises outdoor unit 10 and indoor unit 20. Outdoor unit 10 and indoor unit 20 are connected by refrigerant pipe 30 to form refrigerant circuit 110. Outdoor unit 10 comprises a compressor 11, a four-way valve 12, an outdoor heat exchanger 13, and an air blower 14 serving as an outdoor unit fan. Indoor unit 20 comprises first indoor heat exchanger 21, second indoor heat exchanger 22, an expansion valve 24, and temperature sensors 31, 32.

Refrigerant circuit 110 is configured to circulate the refrigerant through compressor 11, outdoor heat exchanger 13, second indoor heat exchanger 22, expansion valve 24, and first indoor heat exchanger 21 in this order during a cooling operation. During the cooling operation, each of outdoor heat exchanger 13 and second indoor heat exchanger 22 functions as a condenser, and first indoor heat exchanger 21 functions as an evaporator. Air conditioner 100 is configured to circulate the refrigerant through compressor 11, first indoor heat exchanger 21, expansion valve 24, second indoor heat exchanger 22, and outdoor heat exchanger 13 in this order during a heating operation. During the heating operation, first indoor heat exchanger 21 functions as a condenser, and each of second indoor heat exchanger 22 and outdoor heat exchanger 13 functions as an evaporator.

Compressor 11 suctions and compresses low-temperature and low-pressure refrigerant, and discharges the refrigerant as high-temperature and high-pressure gas refrigerant. Compressor 11 is driven by, for example, an inverter, and is controlled in capacity (amount of refrigerant discharged per unit time). Four-way valve 12 switches the flow of the refrigerant in accordance with an operation mode of air conditioner 100.

Outdoor heat exchanger 13 exchanges heat between the refrigerant flowing through refrigerant circuit 110 and the outdoor air. Air blower 14 is located adjacent to outdoor heat exchanger 13. Air blower 14 sends air to outdoor heat exchanger 13. Expansion valve 24 is constituted of, for example, an electronic expansion valve controllable in terms of a degree of opening of the valve. Temperature sensors 31, 32 respectively detect a temperature of the refrigerant before flowing into second indoor heat exchanger 22 and a temperature of the refrigerant after flowing out of second indoor heat exchanger 22. Air conditioner 100 comprises a controller 60 configured to comprehensively control driving components such as air blower 14 and expansion valve 24.

Controller 60 comprises a CPU (Central Processing Unit) 61, a memory 62 (ROM (Read Only Memory) and a RAM (Random Access Memory)), an input/output device (not shown) configured to input and output various signals, and the like. CPU 61 loads a program stored in the ROM into the RAM or the like and executes the program. The program stored in the ROM is a program in which a processing procedure of controller 60 is written. Controller 60 performs control of each device in accordance with such a program. This control is not limited to processing by software, and processing can also be performed by dedicated hardware (electronic circuit).

Controller 60 adjusts an amount of sent air by controlling, for example, a rotation speed of each of air blowers 14, 28, 29. Controller 60 controls a degree of opening of expansion valve 24 to control an amount of decompression of the refrigerant, for example. Controller 60 controls first damper 23*a* and second damper 23*b* to switch the positions of first damper 23*a* and second damper 23*b*, for example. The positions of first damper 23*a* and second damper 23*b* are switched by the control of controller 60, thereby switching between the state in which second indoor heat exchanger 22 is located in the air intake passage and the state in which second indoor heat exchanger 22 is located in the air exhaust passage.

Figure 4:
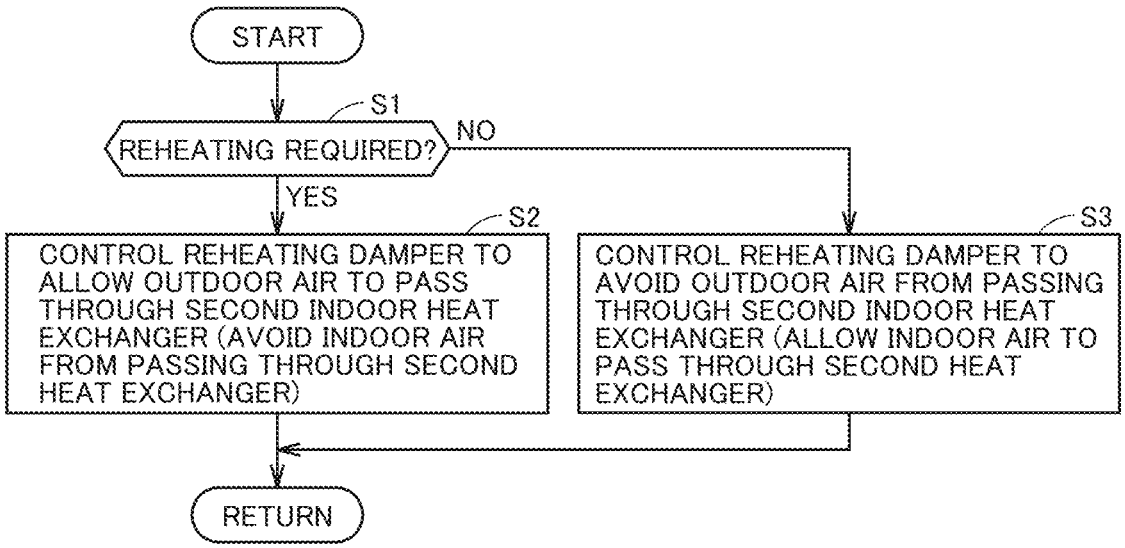
FIG. 4 is a flowchart showing control of a damper during a cooling operation according to the first embodiment.
Figure 5:
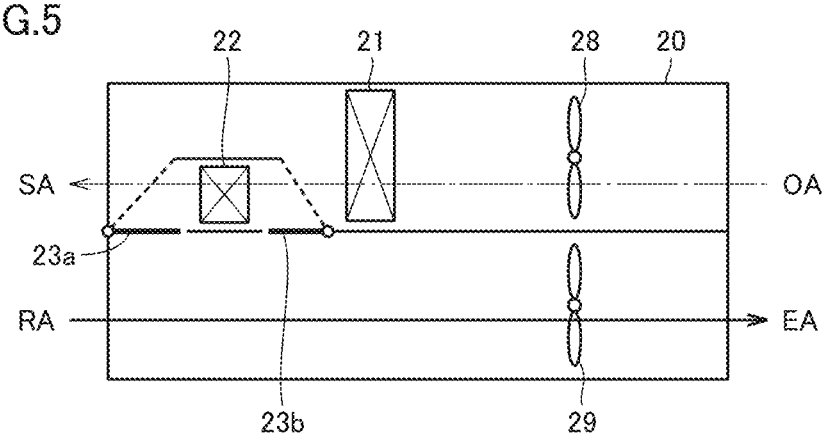
FIG. 5 is a diagram showing an exemplary damper operation according to the first embodiment.
Figure 6:
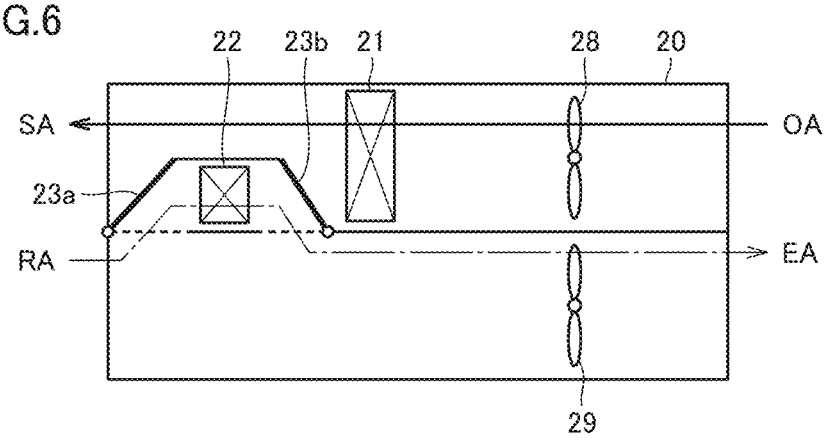
FIG. 6 is a diagram showing an exemplary damper operation according to the first embodiment.

FIG. 4 is a flowchart showing control of the damper during the cooling operation according to the first embodiment. Each of FIGS. 5 and 6 is a diagram showing an exemplary damper operation according to the first embodiment. During the cooling operation, controller 60 controls the degree of opening of expansion valve 24 so as to attain a narrowed state, thereby performing the operation with each of outdoor heat exchanger 13 and second indoor heat exchanger 22 functioning as a condenser and first indoor heat exchanger 21 functioning as an evaporator. The processing of the flowchart of FIG. 4 is repeatedly invoked as a subroutine from a main routine in the control of controller 60 and is executed.

In a step S1, controller 60 determines whether or not reheating is required. Whether or not the reheating is required may be determined by controller 60 based on information transmitted from a remote controller (not shown) operated by the user. It should be noted that a humidity sensor and a temperature sensor may be provided and whether or not the reheating is required may be determined from values of them.

When it is determined that the reheating is required (YES in step S1), i.e., when a cooling/dehumidifying operation is to be performed, controller 60 performs control to switch the reheating damper constituted of first damper 23*a* and second damper 23*b* so as to attain a state in which outdoor air OA passes through second indoor heat exchanger 22 (step S2), and returns the processing from the subroutine to the main routine as shown in FIG. 5. In other words, as shown in FIG. 5, controller 60 performs control to switch the reheating damper so as to attain a state in which indoor air RA does not pass through second indoor heat exchanger 22.

Thus, when the reheating is required, outdoor air OA passes through first indoor heat exchanger 21 and then passes through second indoor heat exchanger 22. Outdoor air OA is cooled by first indoor heat exchanger 21, is then reheated by second indoor heat exchanger 22, and is sent out to the indoor space.

When it is determined that no reheating is required (NO in step S1), i.e., when the cooling/dehumidifying operation is not to be performed, controller 60 performs control to switch the reheating damper constituted of first damper 23*a* and second damper 23*b* so as to attain a state in which outdoor air OA does not pass through second indoor heat exchanger 22 as shown in FIG. 6 (step S3), and returns the processing from the subroutine to the main routine. In other words, as shown in FIG. 6, controller 60 performs control to switch the reheating damper so as to attain a state in which indoor air RA passes through second indoor heat exchanger 22.

Figure 7:
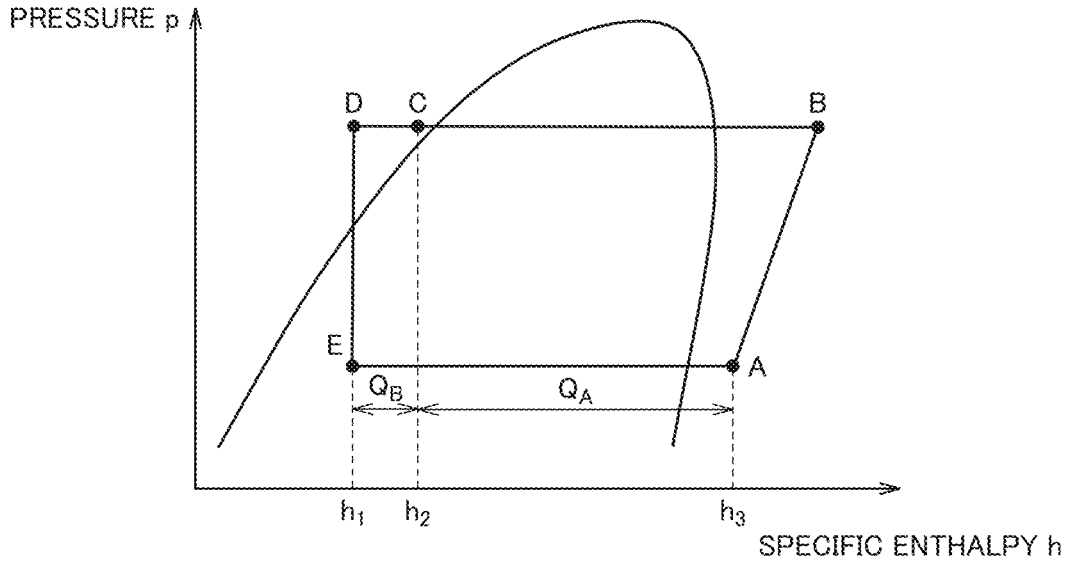
FIG. 7 is a refrigerant state transition diagram according to the first embodiment.

Here, transition of the refrigerant state when no reheating is required will be described with reference to FIG. 7. FIG. 7 is a refrigerant state transition diagram according to the first embodiment. The vertical axis represents a pressure p, and the horizontal axis represents a specific enthalpy h. The p-h diagram illustrates a refrigeration cycle in which each of outdoor heat exchanger 13 and second indoor heat exchanger 22 functions as a condenser and first indoor heat exchanger 21 functions as an evaporator as indicated by a line connecting points A to E.

In FIG. 7, a line segment from point A to point B represents a compression process performed in compressor 11, a line segment from point B to point C represents a condensation process performed in outdoor heat exchanger 13, a line segment from point C to point D represents a condensation process performed in second indoor heat exchanger 22, a line segment from point D to point E represents an expansion process performed in expansion valve 24, and a line segment from point E to point A represents an evaporation process performed in first indoor heat exchanger 21.

As shown in FIG. 7, in the condensation process, air flows through outdoor heat exchanger 13 in the line segment from point B to point C, thereby exchanging heat between the refrigerant and outdoor air OA by a heat amount corresponding to an exchange-heat amount $Q_A$. Thus, the specific enthalpy of the refrigerant flowing into outdoor heat exchanger 13 is decreased from h3 to h2. In the condensation process, air flows through second indoor heat exchanger 22 also in the line segment from point C to point D, thereby exchanging heat between the refrigerant and outdoor air OA by a heat amount corresponding to an exchange-heat amount $Q_B$. Thus, the specific enthalpy of the refrigerant flowing into second indoor heat exchanger 22 is decreased from h2 to h1.

In this way, in the condensation process, the specific enthalpy of the refrigerant is decreased from h3 to h2 in outdoor heat exchanger 13, and the specific enthalpy of the refrigerant is decreased from h2 to h1 in second indoor heat exchanger 22. Therefore, a degree of supercooling of the refrigerant can be increased from the outlet of outdoor heat exchanger 13 at point C to the outlet of second indoor heat exchanger 22 at point D. Thus, when no reheating is required, the exchange-heat amount can be increased and the temperature of outdoor air OA can be decreased highly efficiently.

Second Embodiment

Figure 8:
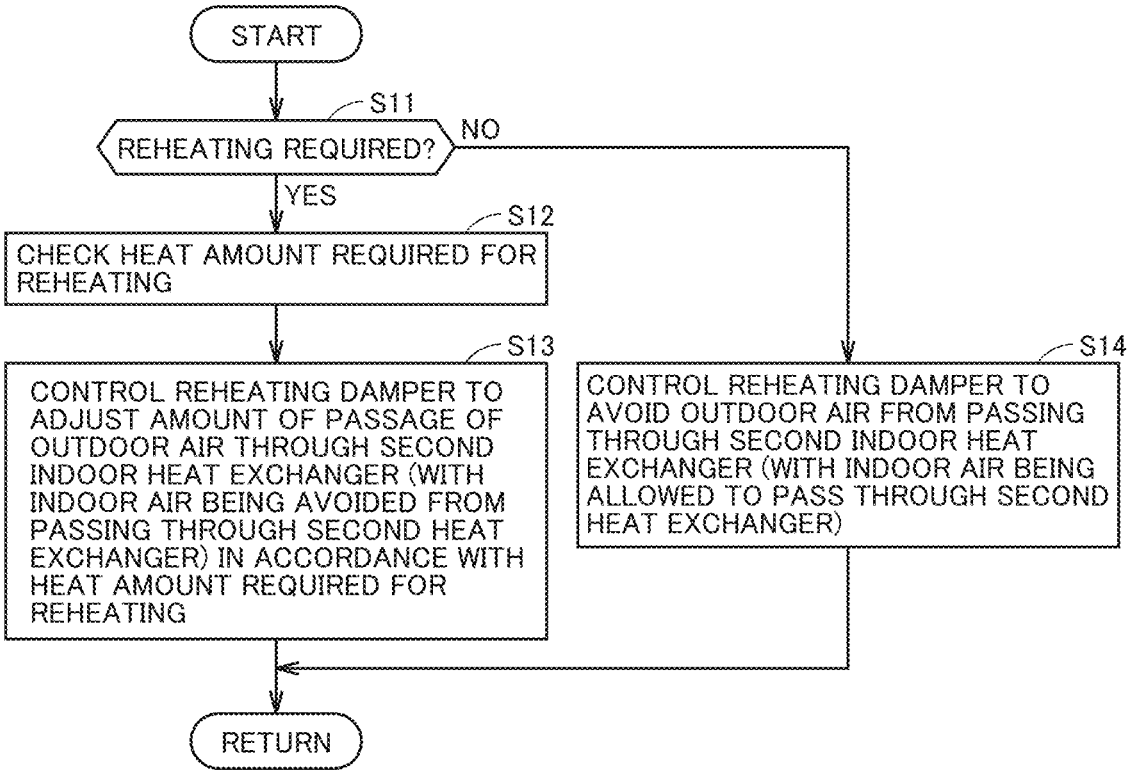
FIG. 8 is a flowchart showing control of a damper during a cooling operation according to a second embodiment.
Figure 9:
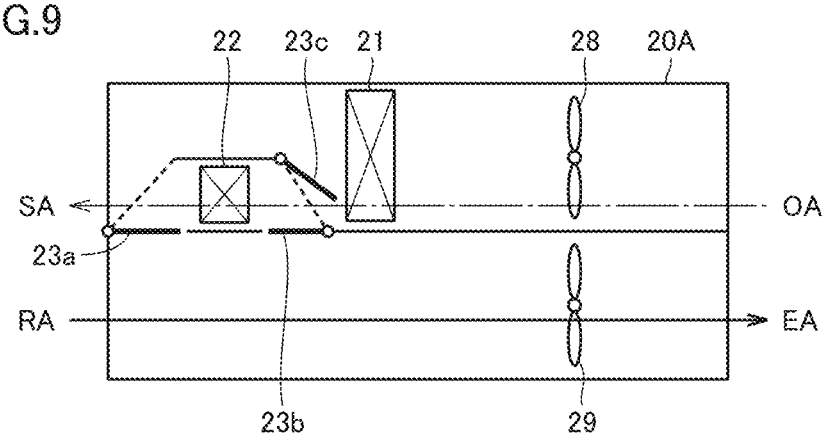
FIG. 9 is a diagram showing an exemplary damper operation according to the second embodiment.

FIG. 8 is a flowchart showing control of a damper during a cooling operation according to a second embodiment. FIG. 9 is a diagram showing an exemplary damper operation according to the second embodiment. An indoor unit 20A of the second embodiment has the same configuration as that of indoor unit 20 of the first embodiment except that indoor unit 20A comprises a third damper 23*c*, which is stepwisely adjustable in angle, in addition to first damper 23*a* and second damper 23*b*. Controller 60 adjusts the angle of third damper 23*c* stepwisely, thereby adjusting an amount of passage of air through second indoor heat exchanger 22. In FIG. 8, the control of the damper will be described by illustrating the control during the cooling operation.

As shown in FIG. 8, in a step S11, controller 60 determines whether or not the reheating is required. When it is determined that the reheating is required (YES in step S11), i.e., when the cooling/dehumidifying operation is to be performed, controller 60 checks a heat amount required for the reheating (step S12). The required reheating amount may be determined by controller 60 based on information transmitted from a remote controller operated by the user. For example, the remote controller may be provided with a button to adjust the heat amount for reheating in the reheating/dehumidifying operation, and information corresponding to the heat amount may be transmitted.

Next, as shown in FIG. 9, controller 60 performs control to switch third damper 23*c* so as to adjust the amount of passage of outdoor air OA through second indoor heat exchanger 22 in accordance with the heat amount required for reheating, and returns the processing from the subroutine to the main routine. On this occasion, as shown in FIG. 9, controller 60 performs control to switch the reheating damper of first damper 23*a* and second damper 23*b*, so as to attain a state in which indoor air RA does not pass through second indoor heat exchanger 22.

When it is determined that no reheating is required (NO in step S11), i.e., when the cooling/dehumidifying operation is not to be performed, controller 60 performs control to switch first damper 23*a* and second damper 23*b* so as to attain a state in which outdoor air OA does not pass through second indoor heat exchanger 22 (step S14), and returns the processing from the subroutine to the main routine. In other words, controller 60 performs control to switch first damper 23*a* and second damper 23*b* so as to attain a state in which indoor air RA passes through second indoor heat exchanger 22.

In this way, since the amount of outdoor air OA flowing through second indoor heat exchanger 22 that is in the state in which second indoor heat exchanger 22 is located in the air intake passage can be stepwisely changed in indoor unit 20A in accordance with the heat amount required for reheating, the reheating/dehumidifying operation can be performed in accordance with the user's request.

Third Embodiment

Figure 10:
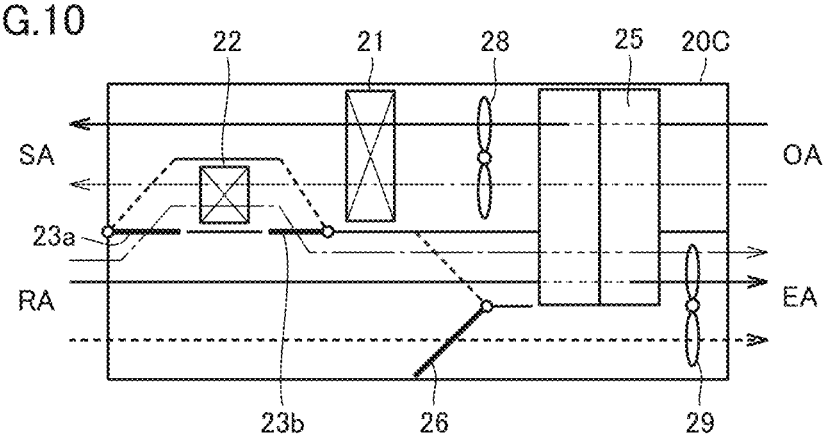
FIG. 10 is a schematic diagram showing a configuration of an indoor unit according to a third embodiment.

FIG. 10 is a schematic diagram showing a configuration of an indoor unit 20C according to a third embodiment. Indoor unit 20C of the third embodiment has the same configuration as that of indoor unit 20 of the first embodiment except that indoor unit 20C comprises a total heat exchanger 25 and a total heat damper 26 provided on the windward side with respect to total heat exchanger 25 in the air exhaust passage.

Total heat exchanger 25 has, for example, a structure in which a plurality of air passages orthogonal to each other are alternately layered. In total heat exchanger 25, indoor air RA and outdoor air OA pass through the air passages, thereby performing total heat exchange between indoor air RA and outdoor air OA. In the total heat exchange, not only sensible heat but also latent heat are exchanged. Total heat damper 26 switches between a state in which total heat exchanger 25 allows indoor air RA flowing through the air exhaust passage to pass through total heat exchanger 25 and a state in which total heat exchanger 25 does not allow indoor air RA to pass through total heat exchanger 25.

Figure 11:
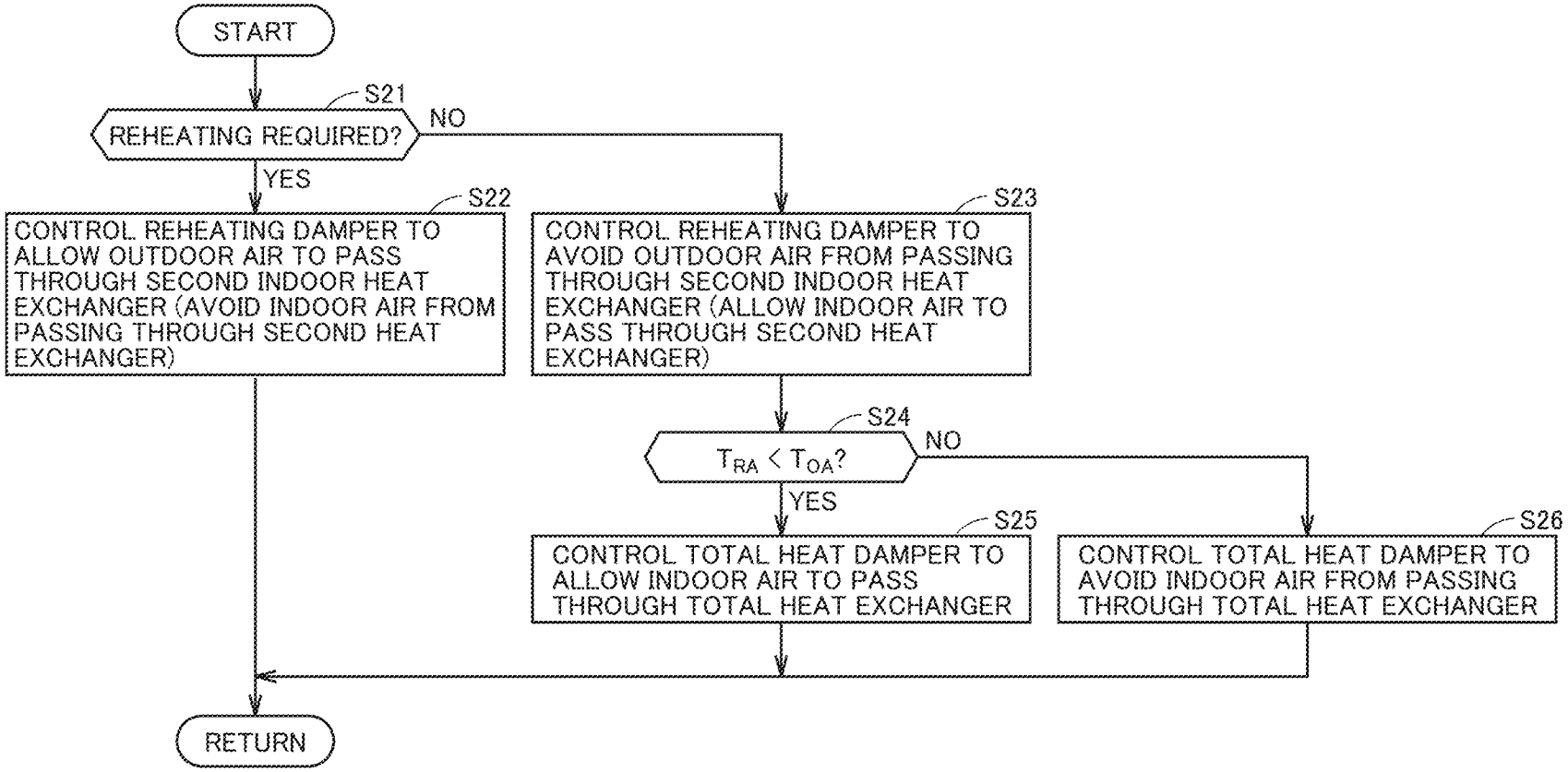
FIG. 11 is a flowchart showing control of a damper during a cooling operation according to the third embodiment.
Figure 12:
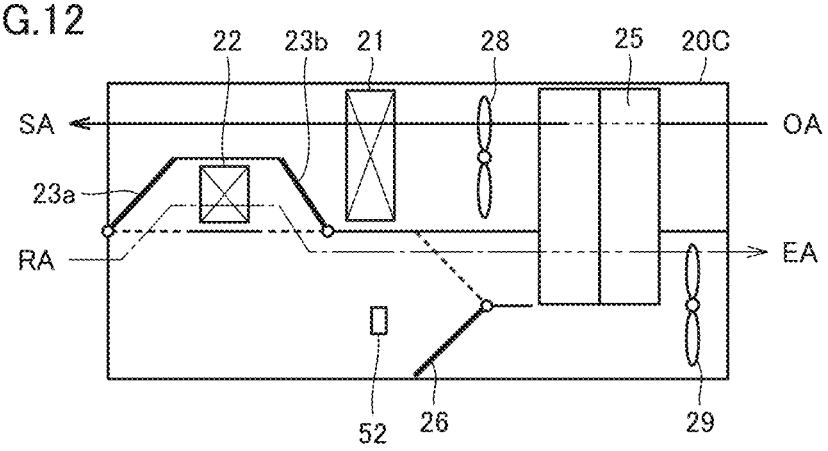
FIG. 12 is a diagram showing an exemplary damper operation according to the third embodiment.
Figure 13:
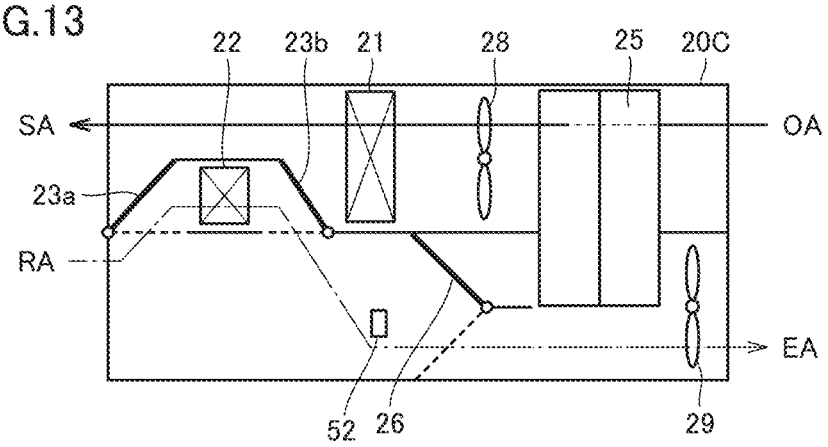
FIG. 13 is a diagram showing an exemplary damper operation according to the third embodiment.

FIG. 11 is a flowchart showing control of the damper during the cooling operation according to the third embodiment. Each of FIGS. 12 and 13 is a diagram showing an exemplary damper operation according to the third embodiment. In FIG. 11, the control of the damper will be described by illustrating the control during the cooling operation.

In a step S21, controller 60 determines whether or not the reheating is required. Whether or not the reheating is required may be determined by controller 60 based on information transmitted from a remote controller (not shown) operated by the user. It should be noted that a humidity sensor and a temperature sensor may be provided and whether or not the reheating is required may be determined from values of them.

When it is determined that the reheating is required (YES in step S21), i.e., when the cooling/dehumidifying operation is to be performed, controller 60 performs control to switch the reheating damper constituted of first damper 23*a* and second damper 23*b* so as to attain a state in which outdoor air OA passes through second indoor heat exchanger 22 (step S22), and returns the processing from the subroutine to the main routine. In other words, controller 60 performs control to switch the reheating damper so as to attain a state in which indoor air RA does not pass through second indoor heat exchanger 22.

Thus, when the reheating is required, outdoor air OA passes through total heat exchanger 25 and first indoor heat exchanger 21, and then passes through second indoor heat exchanger 22. After total heat exchange is performed between indoor air RA and outdoor air OA in total heat exchanger 25, outdoor air OA is cooled by first indoor heat exchanger 21, is then reheated by second indoor heat exchanger 22, and is sent out to the indoor space.

When it is determined that no reheating is required (NO in step S21), i.e., when the cooling/dehumidifying operation is not to be performed, controller 60 performs control to switch the reheating damper constituted of first damper 23*a* and second damper 23*b* so as to attain a state in which outdoor air OA does not pass through second indoor heat exchanger 22 (step S23), and proceeds to processing of a step S24. In other words, controller 60 performs control to switch the reheating damper so as to attain a state in which indoor air RA passes through second indoor heat exchanger 22. Indoor air RA is heated by passing through second indoor heat exchanger 22.

In step S24, controller 60 determines whether or not temperature $T_{RA}$ of indoor air RA after passing through second indoor heat exchanger 22 is lower than temperature $T_{OA}$ of outdoor air OA. Temperature $T_{RA}$ of indoor air RA may be measured by an indoor air temperature detection unit 52 disposed on the leeward side with respect to second indoor heat exchanger 22 in the air exhaust passage. Temperature $T_{OA}$ of outdoor air OA may be measured by outdoor air temperature detection unit 51 shown in FIG. 1.

When it is determined that temperature $T_{RA}$ of indoor air RA is lower than temperature $T_{OA}$ of outdoor air OA (YES in step S24), controller 60 performs control to switch total heat damper 26 so as to allow indoor air RA to pass through total heat exchanger 25 as shown in FIG. 12 (step S25), and returns the processing from the subroutine to the main routine. Thus, the total heat exchange can be performed between indoor air RA and outdoor air OA in total heat exchanger 25, thereby cooling outdoor air OA passing through the air intake passage.

When it is determined that temperature $T_{RA}$ of indoor air RA is higher than temperature $T_{OA}$ of outdoor air OA (NO in step S24), controller 60 performs control to switch total heat damper 26 so as to avoid indoor air RA from passing through total heat exchanger 25 as shown in FIG. 13 (step S26), and returns the processing from the subroutine to the main routine. Thus, when it is not required to cool outdoor air OA passing through the air intake passage, the total heat exchange can be avoided from being performed between indoor air RA and outdoor air OA in total heat exchanger 25.

It should be noted that temperature $T_{RA}$ of indoor air RA after passing through second indoor heat exchanger 22 may be calculated from data such as the room temperature and the exchange-heat amount in second indoor heat exchanger 22. Specifically, the indoor temperature may be measured by a temperature detection unit (not shown) installed in suction port 42. The exchange-heat amount in second indoor heat exchanger 22 may be calculated as a product of a difference between refrigerant specific enthalpies at the inlet and outlet of second indoor heat exchanger 22 and a flow rate of the refrigerant. The refrigerant specific enthalpy at the inlet of second indoor heat exchanger 22 may be calculated from respective measurement values of a low-pressure-side pressure sensor (not shown) installed in refrigerant circuit 110 and temperature sensor 31 shown in FIG. 1 and configured to measure the temperature of the refrigerant flowing into second indoor heat exchanger 22. The refrigerant specific enthalpy at the outlet of second indoor heat exchanger 22 may be calculated from respective measurement values of the low-pressure-side pressure sensor (not shown) installed in refrigerant circuit 110 and temperature sensor 32 shown in FIG. 1 and configured to measure the temperature of the refrigerant flowing out of second indoor heat exchanger 22. The flow rate of the refrigerant may be found by, for example, calculating a refrigerant density at the inlet of compressor 11 from the measurement values of the low-pressure-side pressure sensor installed in refrigerant circuit 110 and a temperature sensor (not shown) configured to measure the temperature at the inlet of compressor 11 and by multiplying the refrigerant density by the excluded volume of compressor 11.

Fourth Embodiment

Figure 14:
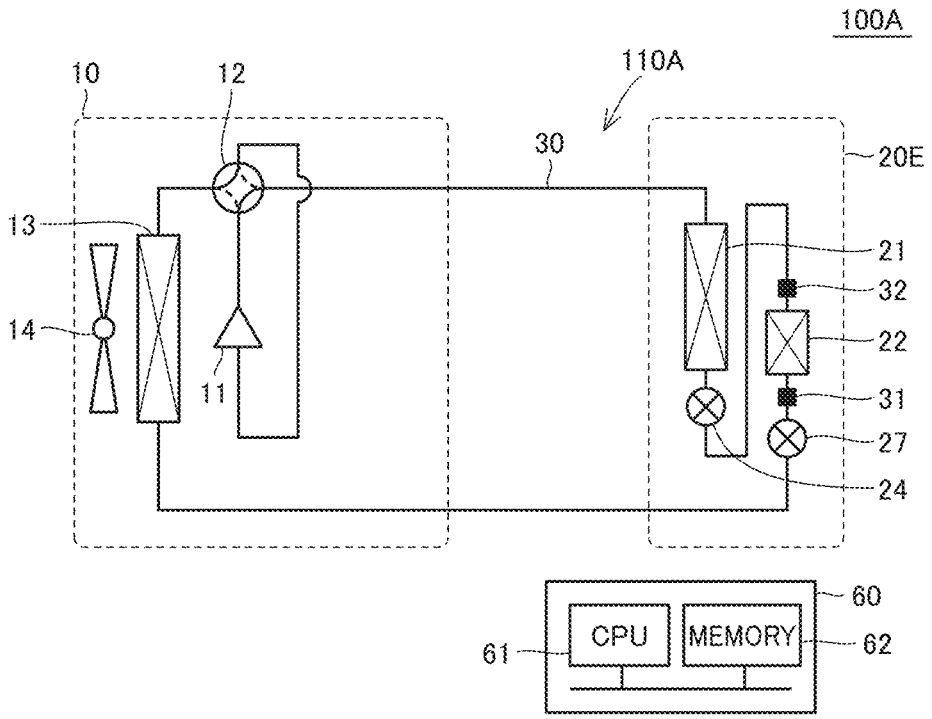
FIG. 14 is a diagram showing a refrigerant circuit of an air conditioner according to a fourth embodiment.
Figure 15:
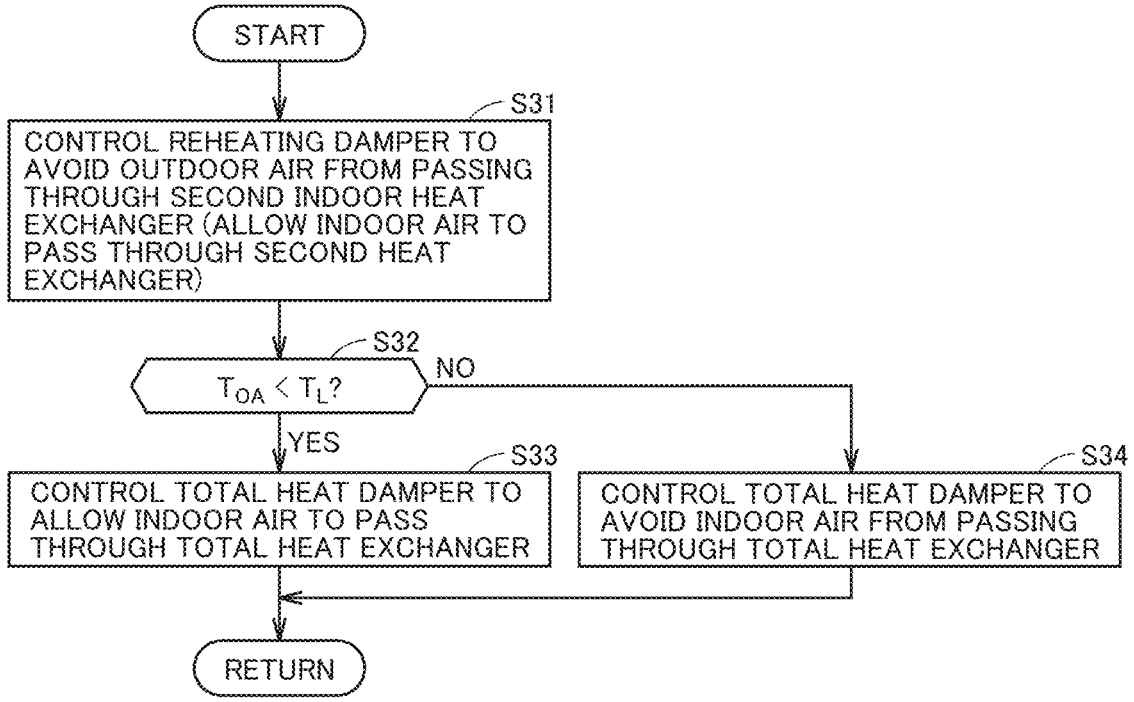
FIG. 15 is a flowchart showing control of a damper during a heating operation according to the fourth embodiment.

In a fourth embodiment, control during a heating operation will be described. FIG. 14 is a diagram showing a refrigerant circuit 110A of an air conditioner 100A according to the fourth embodiment. FIG. 15 is a flowchart showing control of a damper during the heating operation according to the fourth embodiment. Indoor unit 20E in refrigerant circuit 110A of air conditioner 100A according to the fourth embodiment has the same configuration as that of refrigerant circuit 110 according to the first embodiment except that an expansion valve 27 is added. Indoor unit 20E according to the fourth embodiment has the same configuration as that of indoor unit 20C according to the third embodiment except that expansion valve 27 is provided.

Expansion valve 27 is disposed in indoor unit 20E at refrigerant pipe 30 between outdoor heat exchanger 13 and second indoor heat exchanger 22. Controller 60 controls a degree of opening of each of expansion valve 24 and expansion valve 27. During the heating operation, controller 60 controls the degrees of opening to bring expansion valve 24 into an open state by fully opening expansion valve 24 and bring expansion valve 27 into a narrowed state. Refrigerant circuit 110A is configured to circulate the refrigerant through compressor 11, first indoor heat exchanger 21, expansion valve 24, second indoor heat exchanger 22, expansion valve 27, and outdoor heat exchanger 13 in this order during the heating operation. During the heating operation, each of first indoor heat exchanger 21 and second indoor heat exchanger 22 functions as a condenser, and outdoor heat exchanger 13 functions as an evaporator.

As shown in FIG. 15, controller 60 performs control to switch the reheating damper constituted of first damper 23*a* and second damper 23*b* so as to attain a state in which outdoor air OA does not pass through second indoor heat exchanger 22 (step S31), and proceeds to processing of S32. In other words, controller 60 performs control to switch the reheating damper so as to attain a state in which indoor air RA passes through second indoor heat exchanger 22. Indoor air RA is heated by passing through second indoor heat exchanger 22. Thus, the temperature of indoor air RA that may flow into total heat exchanger 25 can be increased by exchanging heat with the refrigerant passing through second indoor heat exchanger 22.

In step S32, controller 60 determines whether or not temperature $T_{OA}$ of outdoor air OA is lower than a preset threshold temperature $T_L$. Preset threshold temperature $T_L$ is a temperature (for example, 0° C.) set as a temperature at which moisture in the air flowing through the air exhaust passage may become frozen. When temperature $T_{OA}$ of outdoor air OA is lower than preset threshold temperature $T_L$, indoor air RA flowing through the air exhaust passage is cooled by outdoor air OA, with the result that the moisture in the air may become frozen. This leads to clogging in total heat exchanger 25, disadvantageously. It should be noted that temperature $T_{OA}$ of outdoor air OA may be measured by outdoor air temperature detection unit 51 shown in FIG. 1.

When it is determined that temperature $T_{OA}$ of outdoor air OA is lower than preset threshold temperature $T_L$ (YES in step S32), controller 60 performs control to switch total heat damper 26 so as to allow indoor air RA to pass through total heat exchanger 25 (step S33), and returns the processing from the subroutine to the main routine. Thus, total heat exchange is performed between indoor air RA flowing into total heat exchanger 25 and having an increased temperature and outdoor air OA having a low temperature. This leads to a reduced possibility that indoor air RA is cooled to a temperature below the freezing point by outdoor air OA having a low temperature and the moisture thereof become frozen to cause freezing of moisture in the air exhaust passage and clogging of total heat exchanger 25.

When it is determined that temperature $T_{OA}$ of outdoor air OA is higher than preset threshold temperature Tt. (NO in step S32), there is no possibility of freezing of moisture in the air exhaust passage and clogging of total heat exchanger 25, and controller 60 therefore performs control to switch total heat damper 26 so as to avoid indoor air RA from passing through total heat exchanger 25 (step S34) and returns the processing from the subroutine to the main routine. Thus, when it is not required to heat outdoor air OA passing through the air intake passage, the total heat exchange between indoor air RA and outdoor air OA can be avoided from being performed in total heat exchanger 25.

CONCLUSION

The present disclosure comprises a refrigerant circuit 110 comprising an outdoor unit 10 and an indoor unit 20. Outdoor unit 10 comprises a compressor 11 configured to compress and discharge refrigerant, and an outdoor heat exchanger 13. Indoor unit 20 comprises an expansion valve 24 configured to decompress the refrigerant, a first indoor heat exchanger 21, a second indoor heat exchanger 22, an air blower 28 configured to bring outdoor air OA into a room through an air intake passage, and an air blower 29 configured to discharge indoor air RA to outside of the room through an air exhaust passage. Refrigerant circuit 110 is configured to circulate the refrigerant through compressor 11, outdoor heat exchanger 13, second indoor heat exchanger 22, expansion valve 24, and first indoor heat exchanger 21 in this order during a cooling operation. Second indoor heat exchanger 22 is configured to allow each of outdoor air OA flowing through the air intake passage and indoor air RA flowing through the air exhaust passage to pass through second indoor heat exchanger 22. Indoor unit 20 further comprises a first damper 23*a* and a second damper 23*b* as a switching device configured to switch between a state in which second indoor heat exchanger 22 is located in the air intake passage and a state in which second indoor heat exchanger 22 is located in the air exhaust passage. When switching is made by the switching device to the state in which second indoor heat exchanger 22 is located in the air intake passage, first indoor heat exchanger 21 is disposed on a windward side with respect to second indoor heat exchanger 22 in the air intake passage.

Preferably, indoor unit 20 further comprises a controller 60 configured to control an operation of each of first damper 23*a* and second damper 23*b*. When outdoor air OA cooled by exchanging heat with the refrigerant by first indoor heat exchanger 21 is required to be heated by second indoor heat exchanger 22, controller 60 controls first damper 23*a* and second damper 23*b* so as to attain the state in which second indoor heat exchanger 22 is located in the air intake passage.

Preferably, when outdoor air OA cooled by exchanging heat with the refrigerant by first indoor heat exchanger 21 is not required to be heated by second indoor heat exchanger 22, controller 60 controls first damper 23*a* and second damper 23*b* so as to attain the state in which second indoor heat exchanger 22 is located in the air exhaust passage.

Preferably, indoor unit 20A further comprises a controller 60 configured to control an operation of each of first damper 23*a*, second damper 23*b*, and a third damper 23*c*. Third damper 23*c* is configured to adjust an amount of passage of outdoor air OA through second indoor heat exchanger 22. When outdoor air OA cooled by exchanging heat with the refrigerant by first indoor heat exchanger 21 is required to be heated by second indoor heat exchanger 22, controller 60 controls third damper 23*c* to stepwisely change an amount of outdoor air OA flowing through second indoor heat exchanger 22 that is in the state in which second indoor heat exchanger 22 is located in the air intake passage.

Preferably, indoor unit 20C further comprises a total heat exchanger 25 configured to exchange heat between outdoor air OA and indoor air RA. The damper serving as the switching device comprises a reheating damper constituted of a first damper 23*a* and a second damper 23*b*, and a total heat damper 26, the reheating damper being configured to switch between the state in which second indoor heat exchanger 22 is located in the air intake passage and the state in which second indoor heat exchanger 22 is located in the air exhaust passage, total heat damper 26 being configured to switch between a state in which total heat exchanger 25 allows indoor air RA flowing through the air exhaust passage to pass through total heat exchanger 25 and a state in which total heat exchanger 25 does not allow indoor air RA to pass through total heat exchanger 25.

Preferably, in a case where outdoor air OA cooled by exchanging heat with the refrigerant by first indoor heat exchanger 21 is not required to be heated by second indoor heat exchanger 22, controller 60 controls the reheating damper so as to attain the state in which second indoor heat exchanger 22 is located in the air exhaust passage, when a temperature $T_{RA}$ of indoor air RA after passing through second indoor heat exchanger 22 is lower than a temperature $T_{OA}$ of outdoor air OA, controller 60 controls total heat damper 26 so as to attain the state in which total heat exchanger 25 allows indoor air RA flowing through the air exhaust passage to pass through total heat exchanger 25, and when temperature $T_{RA}$ of indoor air RA after passing through second indoor heat exchanger 22 is higher than temperature $T_{OA}$ of outdoor air OA, controller 60 controls total heat damper 26 so as to attain the state in which total heat exchanger 25 does not allow indoor air RA flowing through the air exhaust passage to pass through total heat exchanger 25.

Preferably, indoor unit 20E further comprises an expansion valve 27 configured to decompress the refrigerant. Refrigerant circuit 110A is configured to circulate the refrigerant through compressor 11, first indoor heat exchanger 21, expansion valve 24, second indoor heat exchanger 22, expansion valve 27, and outdoor heat exchanger 13 in this order during a heating operation. In a case where each of first indoor heat exchanger 21 and second indoor heat exchanger 22 functions as a condenser by bringing expansion valve 24 into an open state and bringing expansion valve 27 into a narrowed state during the heating operation, when temperature $T_{OA}$ of outdoor air OA is less than a preset threshold temperature $T_L$, controller 60 controls the reheating damper constituted of first damper 23*a* and second damper 23*b* so as to attain the state in which second indoor heat exchanger 22 is located in the air exhaust passage, and controller 60 controls total heat damper 26 so as to attain the state in which total heat exchanger 25 allows indoor air RA flowing through the air exhaust passage to pass through total heat exchanger 25.

Each of air conditioners 100, 100A of the present embodiment has the above-described configuration, and therefore can be operated highly efficiently both when reheating is required and when no reheating is required.

The embodiments disclosed herein are illustrative and non-restrictive in any respect. The scope of the present disclosure is defined by the terms of the claims, rather than the embodiments described above, and is intended to include any modifications within the scope and meaning equivalent to the terms of the claims.

REFERENCE SIGNS LIST

10: outdoor unit; 11: compressor; 12: four-way valve; 13: outdoor heat exchanger; 14, 28, 29: air blower; 20, 20A, 20C, 20E: indoor unit; 21: first indoor heat exchanger; 22: second indoor heat exchanger; 23*a*: first damper; 23*b*: second damper; 23*c*: third damper; 24, 27: expansion valve; 25: total heat exchanger; 26: total heat damper; 30: refrigerant pipe; 31, 32: temperature sensor; 40: duct; 41: sending port; 42: suction port; 50: intake air temperature detection unit; 51: outdoor air temperature detection unit; 52: indoor air temperature detection unit; 60: controller; 61: CPU; 62: memory; 100, 100A: air conditioner; 110, 110A: refrigerant circuit; EA: exhaust air; SA: intake air; OA: outdoor air; RA: indoor air.

The invention claimed is:

1. An air conditioner comprising a refrigerant circuit comprising an outdoor unit and an indoor unit, wherein the outdoor unit comprises a compressor configured to compress and discharge refrigerant, and an outdoor heat exchanger, the indoor unit comprises a first expansion valve configured to decompress the refrigerant, a first indoor heat exchanger, a second indoor heat exchanger, an air intake device configured to bring outdoor air into a room through an air intake passage, and an air exhaust device configured to discharge indoor air to outside of the room through an air exhaust passage, the refrigerant circuit is configured to circulate the refrigerant through the compressor, the outdoor heat exchanger, the second indoor heat exchanger, the first expansion valve, and the first indoor heat exchanger in this order during a cooling operation, the second indoor heat exchanger is configured to allow each of the outdoor air flowing through the air intake passage and the indoor air flowing through the air exhaust passage to pass through the second indoor heat exchanger, the indoor unit further comprises a switching device configured to switch between a state in which the second indoor heat exchanger is located in the air intake passage and a state in which the second indoor heat exchanger is located in the air exhaust passage, and when switching is made by the switching device to the state in which the second indoor heat exchanger is located in the air intake passage, the first indoor heat exchanger is located on a windward side with respect to the second indoor heat exchanger in the air intake passage, the indoor unit further comprises a controller configured to control an operation of the switching device, the indoor unit further comprises a total heat exchanger configured to exchange heat between the outdoor air and the indoor air, and the switching device comprises a first damper and a second damper, the first damper being configured to switch between the state in which the second indoor heat exchanger is located in the air intake passage and the state in which the second indoor heat exchanger is located in the air exhaust passage, the second damper being configured to switch between a state in which the total heat exchanger allows the indoor air flowing through the air exhaust passage to pass through the total heat exchanger and a state in which the total heat exchanger does not allow the indoor air to pass through the total heat exchanger, in a case where the outdoor air cooled by exchanging heat with the refrigerant by the first indoor heat exchanger is not required to be heated by the second indoor heat exchanger, the controller controls the first damper so as to attain the state in which the second indoor heat exchanger is located in the air exhaust passage, when a temperature of the indoor air after passing through the second indoor heat exchanger is lower than a temperature of the outdoor air, the controller controls the second damper so as to attain the state in which the total heat exchanger allows the indoor air flowing through the air exhaust passage to pass through the total heat exchanger, and when the temperature of the indoor air after passing through the second indoor heat exchanger is higher than the temperature of the outdoor air, the controller controls the second damper so as to attain the state in which the total heat exchanger does not allow the indoor air flowing through the air exhaust passage to pass through the total heat exchanger.

2. An air conditioner comprising a refrigerant circuit comprising an outdoor unit and an indoor unit, wherein the outdoor unit comprises a compressor configured to compress and discharge refrigerant, and an outdoor heat exchanger, the indoor unit comprises a first expansion valve configured to decompress the refrigerant, a first indoor heat exchanger, a second indoor heat exchanger, an air intake device configured to bring outdoor air into a room through an air intake passage, and an air exhaust device configured to discharge indoor air to outside of the room through an air exhaust passage, the refrigerant circuit is configured to circulate the refrigerant through the compressor, the outdoor heat exchanger, the second indoor heat exchanger, the first expansion valve, and the first indoor heat exchanger in this order during a cooling operation, the second indoor heat exchanger is configured to allow each of the outdoor air flowing through the air intake passage and the indoor air flowing through the air exhaust passage to pass through the second indoor heat exchanger, the indoor unit further comprises a switching device configured to switch between a state in which the second indoor heat exchanger is located in the air intake passage and a state in which the second indoor heat exchanger is located in the air exhaust passage, and when switching is made by the switching device to the state in which the second indoor heat exchanger is located in the air intake passage, the first indoor heat exchanger is located on a windward side with respect to the second indoor heat exchanger in the air intake passage, the indoor unit further comprises a controller configured to control an operation of the switching device, the indoor unit further comprises a total heat exchanger configured to exchange heat between the outdoor air and the indoor air, and the switching device comprises a first damper and a second damper, the first damper being configured to switch between the state in which the second indoor heat exchanger is located in the air intake passage and the state in which the second indoor heat exchanger is located in the air exhaust passage, the second damper being configured to switch between a state in which the total heat exchanger allows the indoor air flowing through the air exhaust passage to pass through the total heat exchanger and a state in which the total heat exchanger does not allow the indoor air to pass through the total heat exchanger, the indoor unit further comprises a second expansion valve configured to decompress the refrigerant, the refrigerant circuit is configured to circulate the refrigerant through the compressor, the first indoor heat exchanger, the first expansion valve, the second indoor heat exchanger, the second expansion valve, and the outdoor heat exchanger in this order during a heating operation, and in a case where each of the first indoor heat exchanger and the second indoor heat exchanger functions as a condenser by bringing the first expansion valve into an open state and bringing the second expansion valve into a narrowed state during the heating operation, when the temperature of the outdoor air is less than a preset threshold value, the controller controls the first damper so as to attain the state in which the second indoor heat exchanger is located in the air exhaust passage, and the controller controls the second damper so as to attain the state in which the total heat exchanger allows the indoor air flowing through the air exhaust passage to pass through the total heat exchanger.

* * * * *